United States Patent [19]

Riss et al.

[11] Patent Number: 4,516,791

[45] Date of Patent: May 14, 1985

[54] SAFETY SKI BINDING

[75] Inventors: Wilfried Riss; Theodor Nitschko, both of Vienna; Engelbert Spitaler, Wr. Neudorf; Gerhard Oberleitner, Vienna, all of Austria

[73] Assignee: TMC Corporation, Baar, Switzerland

[21] Appl. No.: 479,407

[22] Filed: Mar. 28, 1983

[30] Foreign Application Priority Data

Mar. 30, 1982 [AT] Austria ..... 1230/82

[51] Int. Cl.[3] ..... A63C 9/08

[52] U.S. Cl. ..... 280/612

[58] Field of Search ..... 280/611, 612, 625, 627

[56] References Cited

U.S. PATENT DOCUMENTS

| | | | |
|---|---|---|---|
| 3,919,563 | 11/1975 | Lautier et al. | 280/612 |
| 4,311,321 | 1/1982 | Svoboda | 280/611 |
| 4,385,773 | 5/1983 | Scheck et al. | 280/612 |
| 4,444,411 | 4/1984 | Svoboda et al. | 280/612 |
| 4,463,968 | 8/1984 | Hull | 280/612 |

*Primary Examiner*—Joseph F. Peters, Jr.
*Assistant Examiner*—Ross Weaver
*Attorney, Agent, or Firm*—Flynn, Thiel, Boutell & Tanis

[57] ABSTRACT

A safety ski binding includes a holding jaw and a jaw which can be released electrically under control of a control circuit. The holding jaw includes two movable sole holders having thereon pistons movable in respective, fluid-filled chambers. The holding jaw also includes a movable stepping plate, and the stepping plate and one sole holder can each flex respective membranes of a further fluid-filled chamber. Each of the three chambers communicates with a respective piezoelectric element which is connected to the control circuit. Forces applied to the holding jaw by a ski boot can increase the pressure in the various chambers and the piezoelectric elements each produce a signal proportional to such pressure, the control circuit electrically releasing the other jaw if the forces exceed predetermined values.

5 Claims, 5 Drawing Figures

SAFETY SKI BINDING

FIELD OF THE INVENTION

The invention relates to a safety ski binding and, more particularly, to a binding having two jaws which hold the ski boot, preferably a releasable heel holder and a holding jaw, a sensing system for detecting a force which acts onto the ski boot upwardly or downwardly, transversely and, if desired, longitudinally, wherein signals generated by the sensing system are processed in a control circuit which, if pregiven limit values are exceeded, emits a release signal to the releasable jaw.

BACKGROUND OF THE INVENTION

A sensing device of the above-mentioned type is described for example in German Offenlegungsschrift No. 29 48 277. The safety ski binding which is disclosed therein includes a front jaw and a heel holder which is pivotal about a transverse axis (see FIGS. 1 to 3). As a particularly break-endangered cross section of the leg of the skier, there is assumed a transverse axis which is above the leg of the boot and in the longitudinal direction of the ski approximately intermediate the front and the rear boot-leg edge. A first pressure sensor is provided between the tip of the sole of the boot and its point of contact on the holding jaw, and further pressure sensors are arranged below the sole of the boot and between a sole down-holding means which is arranged on the heel holder and the upper side of the boot sole and the stepping spur of the heel holder. Considering the distances of the pressure sensors from the break-endangered cross section at the transverse axis, and considering the forces which act onto the pressure sensors, a release signal can be formed in the control circuit. This sensing device, however, is discussed from a purely theoretical point of view, and no structural arrangement is disclosed which shows how in the case of a binding which consists of two jaws the sensing of forces can be done.

In a common safety ski binding, either one or two sole holders are provided which can be swung up or out against a spring force. Even though the release force can be adjusted by changing the initial tension of the spring, it is not possible in such a binding to detect in a sufficient manner all forces which endanger the leg of the skier.

A purpose of the invention is therefore to design a sensing device of the above-mentioned type in which detection of all dangerous forces which act onto the leg of the skier is possible.

SUMMARY OF THE INVENTION

The set purpose is attained inventively by providing on the holding jaw two sole holders which hold the ski boot sole from above and from the side and which are supported slightly pivotally on a pin which extends perpendicular to the upper side of the ski and is itself slightly pivotally supported by a further pin which extends transversely to the longitudinal direction of the ski and parallel to the upper side of the ski. The sole holders are each provided with a respective pressure Piston which can act on either a differential pressure cell or a respective absolute pressure cell, and at least one of the sole holders has in a region which does not face the ski boot a pressure pin which can act on a further absolute pressure cell. A stepping plate is supported slightly pivotally on the further pin which extends transversely to the longitudinal axis of the ski, parallel to and is spaced from the upper side of the ski. The stepping plate carries at its end region which does not face the ski boot a pressure pin which can also act on the further absolute pressure cell.

The inventive sensing device permits detection of the forces which occur in the region of the holding jaw. In the case that absolute pressure cells are provided, it permits a detection of forces which act transversely to the longitudinal axis of the ski and longitudinally of the ski through subtraction or addition of the signals which correspond to the measured values and are produced by the absolute pressure cells which are arranged on the sole holders. For an increase in the pressure applied by the boot to one of the sole holders or to both or to the stepping plate in a vertical direction, the pressure pin which is arranged on the sole holder or the pressure pin on the stepping plate acts on the further absolute pressure cell. If sensing of the force which occurs in the longitudinal direction of the ski is not necessary, a differential pressure cell which cooperates with the two pressure pistons arranged on the sole holders can be used to detect the forces which act transversely to the longitudinal axis of the ski.

An advantageous development of the invention includes the pressure pin of the sole holder and the pressure pin of the stepping plate acting onto respective membranes of a closed sensing chamber filled with pressure fluid, which membranes extend approximately parallel to the upper side of the ski, the pressure pin of the sole holder acting from above and the pressure pin of the stepping plate acting from below, and a further surface of the sensing chamber being defined by the membrane of the further absolute pressure cell. In this manner, a structurally simple arrangement is provided for transferring forces which act vertically onto the sole holder or onto the stepping plate in the area of the ball of the foot to the absolute pressure cell. The resulting force is measured as an absolute force, and a signal corresponding to this measured force is produced by the absolute pressure cell and processed in the control circuit.

In order to permit the sole holders to carry out both a horizontal and also a small vertical swivelling movement, it is provided inventively that the pin which extends perpendicular to the upper side of the ski is held in a bearing member which is supported on a further pin which extends parallel to the upper side of the ski, transversely to the longitudinal axis of the ski, and is held by means of its end regions in fastening plates of a ski-fixed housing which carries the pressure cells.

According to a further advantageous development of the invention, the stepping plate has two holding plates which extend perpendicular to the upper side of the ski and parallel to the longitudinal axis of the ski, respectively extend into the area between the bearing member and a respective one of the fastening plates of the housing, and by means of which the stepping plate is pivotally supported on the pin.

The cooperation of the two sole holders with the absolute pressure cells or with the differential pressure cell is, according to a further characteristic of the invention, significantly simplified by providing on each sole holder, in a region which does not face the ski boot, a holding arm on which a respective one of the pressure pistons is provided, each piston extending inwardly toward the longitudinal axis of the ski and engaging a respective membrane which defines one side of a respective chamber filled with pressure fluid, a further side of each such chamber being formed either by a respective one of the membranes of the differential pressure cell or by the membrane of a respective one of the two absolute pressure cells, which are arranged in alignment with one another.

BRIEF DESCRIPTION OF THE DRAWINGS

Further details, advantages and characteristics of the invention will now be described in greater detail in connection with the drawings, which illustrate one exemplary embodiment of a jaw embodying the invention.

In the drawings.

DETAILED DESCRIPTION

Figure 1:
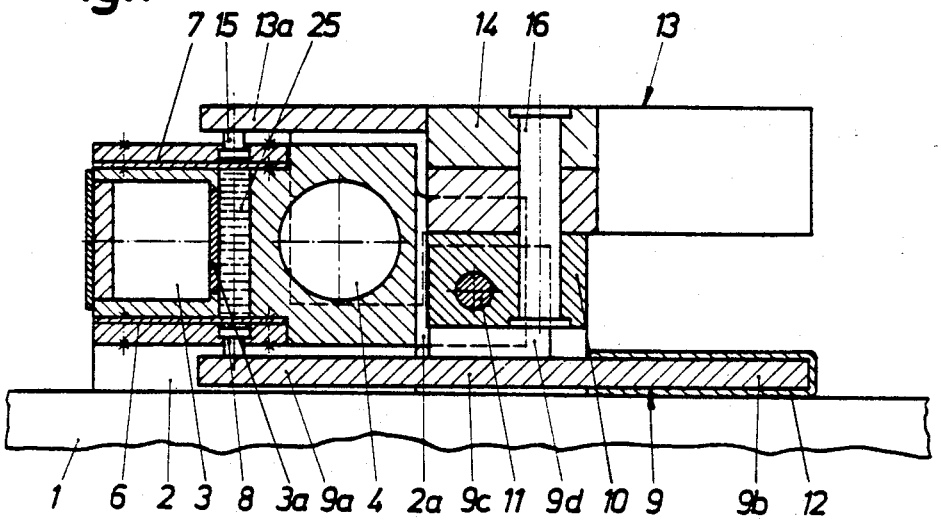
FIG. 1 is a longitudinal sectional side view of an exemplary embodiment of a jaw embodying the invention.
Figure 2:
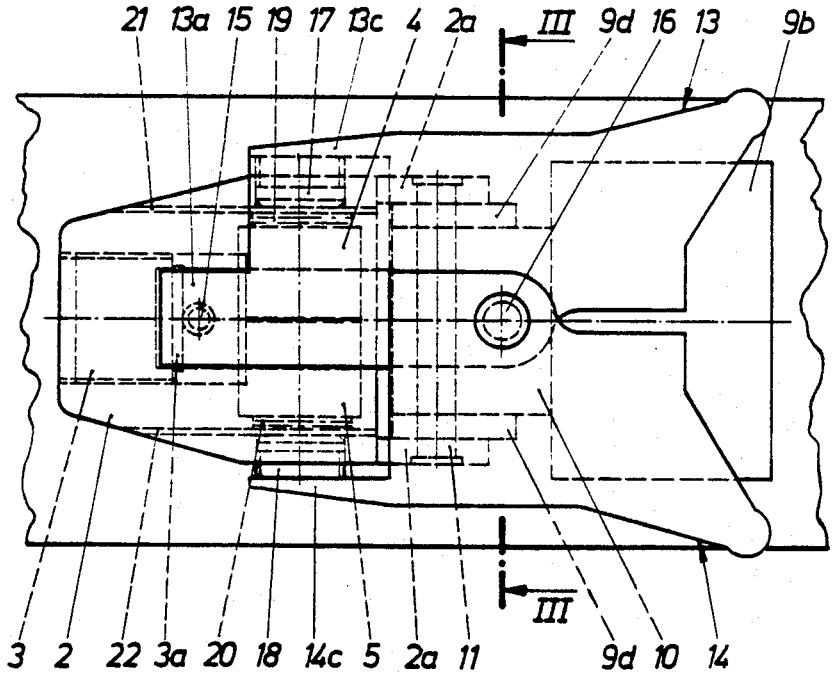
FIG. 2 is a top view of the jaw of FIG. 1.

As can be seen from FIG. 1, a housing 2 is secured on a ski 1. The housing 2 can also be connected fixedly to the ski 1 with the interpositioning of a conventional base plate (not illustrated). Three pressure cells 3, 4 and 5 are installed in the housing 2, for example by being screwed in. The pressure cell 3 is hereby provided in the region of the housing 2 which is nearest the tip of the ski, and the two pressure cells 4 and 5 are installed in longitudinal and vertical alignment with one another approximately in the center of the jaw. The pressure cells 3, 4 and 5 are absolute pressure cells, as compared to differential pressure cells, the pressure cell 3 being provided for detecting forces which act in a vertical direction, and the pressure cells 4 and 5 being provided for detecting forces which act in horizontal directions laterally and longitudinally of the ski, the directions of these forces being defined with reference to the plane of the top surface of the ski.

It is possible to use commercially available pressure cells, e.g. pressure cells manufactured by the company Druckund Kraftmesstechnik H. W. Keller, CH 8404 Winterthur (Switzerland), model nos. PA-10, PR-10 or PA-14.

The pressure cell 3 is positioned in the housing so that its steel membrane 3*a* is perpendicular to the upper side of the ski and to the longitudinal axis of the ski. The steel membrane 3*a* forms one wall of an elongate, closed sensing chamber 25 which is filled with a substantially incompressible pressure fluid, extends substantially parallel to the steel membrane 3*a*, and has bottom and top walls which extend parallel to the upper side of the ski and are formed by respective flexible membranes 6 and 7. The lower membrane 6 can be flexed inwardly by a pressure pin 8 secured on an extension 9*a* of a stepping plate 9, and the upper membrane 7 can be flexed inwardly by a pressure pin 15 which is secured on a sole holder 13.

Figure 3:
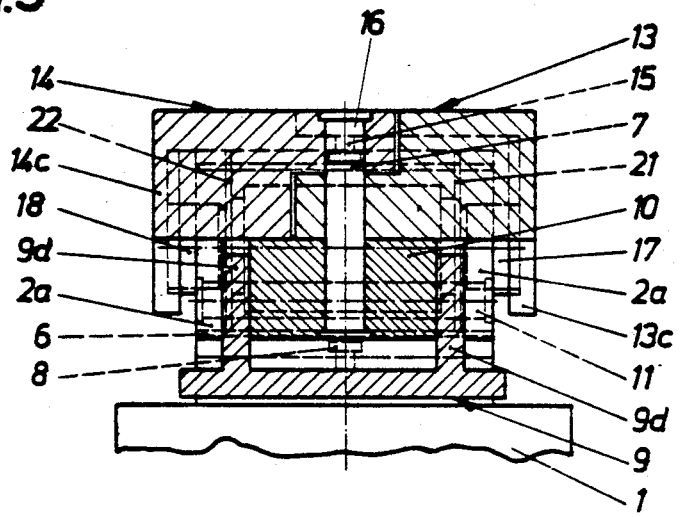
FIG. 3 is a sectional rear view taken along the line III—III of FIG. 2.

The stepping plate 9 forms, together with its extension 9*a*, a flat plate, the end region 9*b* of the stepping plate 9, which is remote from the extension 9*a*, being adapted to support the ball region of a ski boot sole. The center section 9*c* of the stepping plate 9, which is adjacent the stepping region 9*b*, carries two holding plates 9*d* (FIG. 3) which are arranged symmetrically with respect to the longitudinal axis of the ski and extend at a right angle with respect to the upper side of the ski. Two fastening plates 2*a* provided on the housing 2 overlap the two holding plates 9*d* of the stepping plate 9. A pin 11 which extends parallel to the upper side of the ski and transversely with respect to the longitudinal axis of the ski is held by means of its end areas in the fastening plates 2*a* of the housing 2. The pin 11 also extends through the holding plates 9*d* of the stepping plate 9, whereby a pivotal support of the stepping plate 9 on the pin 11 is effected, and between the underside of the stepping plate 9 and the upper side of the ski 1 there exists a small space or vertical clearance. Thus, the stepping plate 9 is permitted to carry out a limited swivelling movement about the pin 11. If no ski boot is inserted into the jaw, so that the jaw is in the position illustrated in FIG. 1, the stepping plate 9 is held in a position which is generally parallel to the upper side of the ski, on the one hand by the pressure pin 8 which engages the flexible membrane 6 of the sensing chamber 25 and on the other hand by an elastic sleeve 12 which surrounds the stepping plate 9 at least in the region thereof which is not covered by the housing 2. The sleeve 12 also prevents a penetration of snow and dirt into the region which exists between the stepping plate 9 and the upper side of the ski. Furthermore, between the two holding plates 9*d* of the stepping plate 9, a bearing member 10 is pivotally supported on the pin 11 at a distance from the upper side of the stepping plate 9 and in the present exemplary embodiment is designed as a square-shaped block. The function of the bearing member 10 will be discussed below.

The pressure pin 15 which engages the upper membrane 7 of the sensing chamber 25 is secured on an arm 13*a* of the sole holder 13. The sole holder 13, together with a second sole holder 14, holds the front end of a ski boot sole (not illustrated), both from above and also from the side. Each of the sole holders 13 and 14 has a region which at least partially covers the bearing member 10 from above, which regions overlap one another. By means of these overlapping regions of the two sole holders 13 and 14, they are pivotally supported on a common vertical axle which is constructed as a further pin 16. The pin 16 is supported by the bearing member 10 and extends perpendicular to the upper side of the ski. Each of the sole holders 13 and 14 has a respective holding arm 13*c* and 14*c* which carries a respective pressure piston 17 and 18. The two pressure pistons 17 and 18 extend from the associated holding arm 13*c* or 14*c* of the sole holder 13 or 14 inwardly toward the longitudinal axis of the ski in a direction generally parallel to the upper side of the ski and at a right angel with respect to the longitudinal axis of the ski. Each of the pressure pistons 17 and 18 engages a respective flexible membrane 21 and 22, which membranes 21 and 22 each define one surface of a respective sensing chamber 19 or 20 which is filled with a substantially incompressible pressure fluid. A surface of each chamber 19 and 20 remote from the pressure piston 17 or 18 is formed by a membrane of one of the two pressure cells 4 and 5.

The pressure cells are preferably piezoelectric, temperature-compensated pressure cells. The voltage which is produced by the piezoelectric crystal is transmitted to and further processed (amplified, filtered, etc.) in a control circuit, which can be located in the front jaw or in the not-illustrated heel holder of the ski binding. If the electrical signals which are produced by the pressure cells 3, 4 and 5 exceed certain predetermined values which are stored in the control circuit and correspond for a given skier to specific data such as weight, boot size, tibia head diameter, then a release signal is produced by the control circuit and causes a release of a locking mechanism which is provided in the not-illustrated heel holder and is for example controlled by means of an electromagnet, thereby effecting a release of the ski boot from the binding at the heel holder. The voltage supply for the control circuit and the release mechanism is provided by batteries which are preferably disposed in the heel holder or in the ski. Since the heel holder is not a part of the subject matter of the present invention, its design is not discussed in greater detail. Of course, the heel holder is also preferably equipped with force-measuring sensors, so that the locking mechanism is also released to free the ski boot if the boot heel transmits impermissibly high forces to the heel holder.

Such a heel holder is shown for instance in prior U.S. patent application Ser. No. 315 671.

When the ski boot is inserted into the binding, the skier's weight, through the ski boot, exerts a force on the stepping plate 9. This force is thereby transmitted to the fluid in chamber 25 and thus to the pressure cell 3 and is considered by the control circuit in comparison to the stored body weight of the skier. Due to the conventional forward pressure normally exerted on the boot by the heel holder, the sole holders 13 and 14 pivot slightly and a certain force is thereby applied by the sole holders 13 and 14 to the fluid in chambers 19 and 20 and thus to the pressure cells 4 and 5, producing a signal which is also considered by the control circuit.

If now an increased forward pressure is applied to the jaw by the ski boot sole in the longitudinal direction of the ski, as can occur for example during a forward fall of the skier, then the sole holders 13 and 14 both pivot slightly further outwardly about the pin 16, which causes the force which is transmitted by the pressure pistons 17 and 18 to the pressure fluid in the chambers 19 and 20 and thus to the pressure cells 4 and 5 to be increased. If only one of the two sole holders 13 and 14 is urged by the boot in a horizontal direction, then only the pressure cell 4 or 5 which is associated with the respective sole holder 13 or 14 is subjected to an increased force. By adding up in the control circuit the signals which represent the two measured variables and are produced by the two pressure cells 4 and 5, the forces which act in the longitudinal direction of the ski are determined. By subtracting the signals, the laterally acting forces are determined. The control circuit, therefore, after considering the sum and difference of the signals representing the forces sensed by the pressure cells 4 and 5, as well as the signals which are produced simultaneously by the heel holder, determines whether they exceed pregiven threshold values and thus whether to produce a release signal to the heel holder locking mechanism.

An increase in the force applied by the boot sole to the sole holders 13 and 14 in a vertical direction away from the ski, which occurs for example during a backward fall of the skier, is transmitted by the sole holder 13 to the fluid in chamber 25 and thus to the pressure cell 3. Since the pin 16 which carries the sole holder 13 is held in the bearing member 10, which itself is pivotal about the pin 11 relative to the housing 2, the pressure pin 15 which is arranged on the sole holder 13 flexes the membrane 7 of the sensing chamber 25 inwardly. The pressure fluid which is contained in the chamber 25 presses in turn onto the membrane 3*a* of the pressure cell 3. An electrical signal is produced, is fed to the control circuit, and is considered in determining whether a release signal should be generated.

An increased sole pressure onto the stepping plate 9, as occurs for example during a forward fall of the skier, effects a small pivoting of the stepping plate 9 about the bolt 11, causing the pressure pin 8 which is secured on the extension 9*a* of the stepping plate 9 to flex the flexible membrane 6 of the sensing chamber 25 inwardly so that the force which is transmitted by the fluid to the membrane 3*a* of the pressure cell 3 is increased. The signal which is produced by the pressure cell 3 and fed to the control circuit is increased and is considered when determining whether to produce a release signal.

In place of the two pressure cells 4 and 5, a differential pressure cell can be used, the two membranes of which are associated with the sole holders 13 and 14, so that measuring of the difference in the forces transmitted by the sole holders 13 and 14 onto the membranes is possible. Forces which act in the longitudinal direction of the ski can be detected by a pressure cell of this type.

Figure 4:
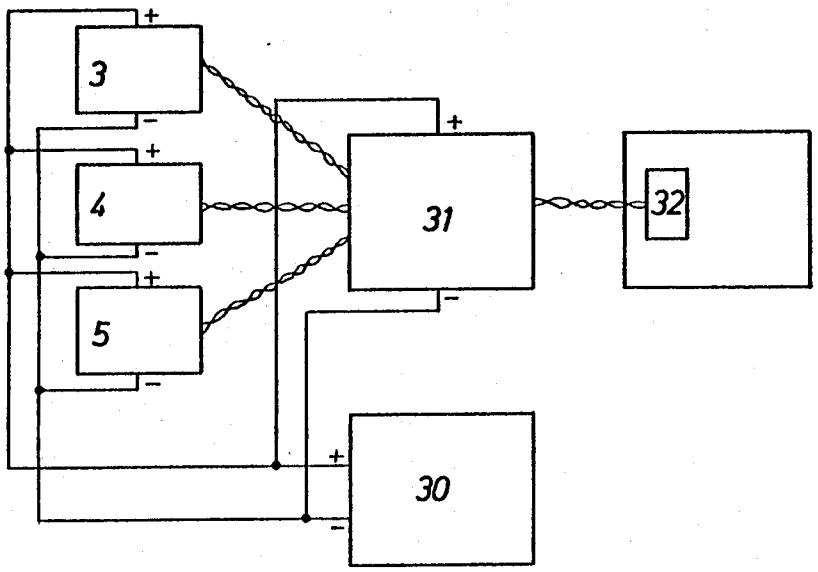
FIG. 4 is a block diagram for a control unit for controlling a releasable jaw embodying the present invention.

FIG. 4 illustrates a block diagram including a power supply unit 30 connected to the pressure sensors 3, 4, 5 and to the control unit 31. The pressure sensors 3, 4, 5 are connected to the control unit 31, which itself is connected to a solenoid 32 representing the locking mechanism of heel holder 33.

Figure 5:
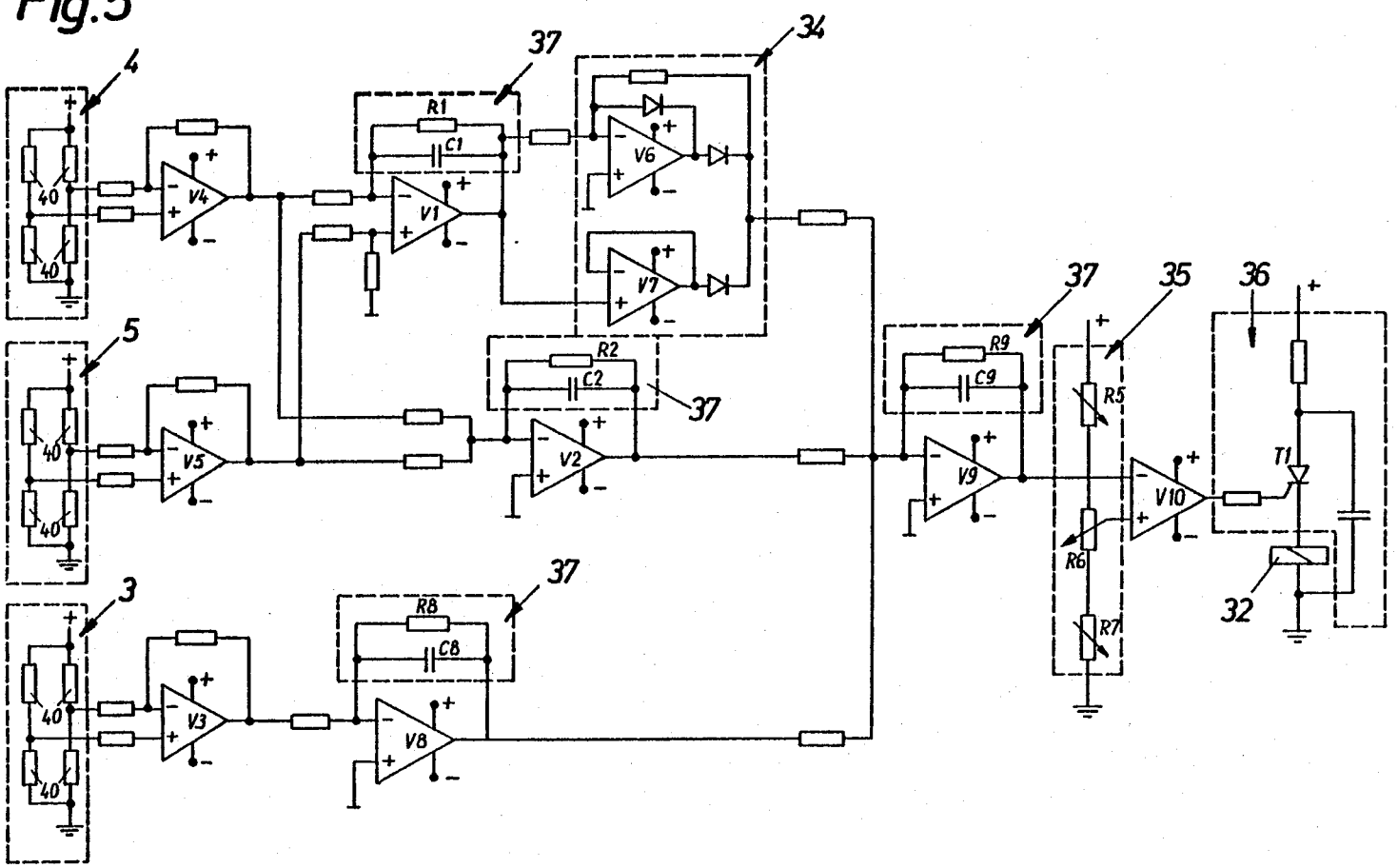
FIG. 5 is a schematic diagram of an exemplary circuit implementing different parts of the control unit of FIG. 4.

FIG. 5 illustrates an exemplary circuit for the control unit 31. The piezoelectric pressure cells 3, 4, 5 are formed by bridge circuits of resistance strain sensors 40. The output signals of the pressure cells 3, 4, 5 are amplified by amplifiers V3, V4, V5. The output signals of the amplifiers V4 and V5 are fed to an integrator V1 for adding up and to an integrator V2 for substraction respectively. The output signal of the integrator V1 is fed to a rectifier 34, which includes two amplifiers V6 and V7, for building the absolute value. The output signal of the amplifier V3 is fed to an integrator V8. The output signals of the rectifier 34, the integrator V2 and the integrator V8 are summed up in a summing amplifier V9 and are then fed to an amplifier V10 which acts as a threshold switch, the switching threshold of which is determined by variable resistors R5, R6 and R7, which resistors are provided in a storage unit 35 and have values corresponding to user-specific data. The output driver 36 which is driven by the threshold switch is formed by a thyristor T1 which is connected to and controls the solenoid 32.

The R-C network comprising resistor R81 and capacitor C1 (feedback path of the integrator V1), resistor R2 and capacitor C2 (feedback path of the integrator V2), resistor R8 and capacitor C8 (feedback path of the integrator V8), and resistor R9 and Capacitor C9 are provided in an exchangeable program storage 37 which is selected to correspond to the ability group of the particular skier, for example a beginning or sport skier, the signal amplification and dynamic release behaviour being predetermined by the particular component values selected so as to correspond to the appropriate ability group.

For a more detailed description of the control unit 31 reference is made to the U.S. application Ser. No.

315,671, which is an earlier application and which includes a control unit very similar to that described above.

The invention is not limited to the illustrated exemplary embodiment. Further modifications and variations, including the rearrangement of parts, are possible without leaving the scope of the invention.

The embodiments of the invention in which an exclusive property or privilege is claimed are defined as follows:

1. In a safety ski binding which includes two jaws which hold a ski boot, of which one can be released in an electric manner and the other one is constructed as a holding jaw which has a sensing element for detecting forces which act onto the ski boot upwardly, downwardly, and transversely, wherein signals which are produced by the sensing element can be processed in a control circuit which, if predetermined limit values are exceeded, emits a release signal, the improvement comprising wherein the holding jaw has two sole holders which hold the ski boot sole from above and from the side, are hinged slightly swingably on a pin which extends perpendicular to the upper side of the ski and are also slightly swingable about a further pin which extends transversely to the longitudinal direction of the ski and parallel to the upper side of the ski, wherein the sole holders are each provided with a pressure piston which acts on at least one of a differential pressure cell and a respective absolute pressure cell, wherein at least one of the sole holders has in a region which does not face the ski boot a pressure pin which can act on a further absolute pressure cell, and wherein a stepping plate is slightly pivotally supported a small distance from the upper side of the ski on the further pin which extends transversely to the longitudinal direction of the ski and parallel to the upper side of the ski, which stepping plate carries at its end which does not face the ski boot a pressure pin which can also act on the further absolute pressure cell, each of the pressure cells being part of the sensing element.

2. The ski binding according to claim 1, wherein the pressure pin of the sole holder and the pressure pin of the stepping plate act onto respective membranes of a sensing chamber filled with pressure fluid, which membranes extend approximately parallel to the upper side of the ski, the pressure pin of the sole holder acting from above and the pressure pin of the stepping plate acting from below, and wherein a further surface of the sensing chamber includes a membrane of the further absolute pressure cell.

3. The ski binding according to claim 1, wherein the pin which extends perpendicular to the upper side of the ski is held in a bearing member which is supported on the further pin which extends parallel with respect to the upper side of the ski and transversely with respect to the longitudinal direction of the ski, the further pin being held by means of its end areas in fastening plates of a ski-fixed housing which carries the pressure cells.

4. The ski binding according to claim 3, wherein the stepping plate has two holding plates which extend perpendicular to the upper side of the ski and parallel to the longitudinal axis of the ski, which holding plates each extend into the region between the bearing member and a respective one of the fastening plates of the housing and by means of which the stepping plate is pivotally supported on the further pin which extends transversely to the longitudinal axis of the ski.

5. The ski binding according to claim 1, wherein each sole holder is provided with a holding arm in a region which does not face the ski boot, on which holding arm is secured one of the pressure pistons which extends in a direction transversely to the longitudinal axis of the ski, and wherein the pressure pistons each engage a membrane which defines one side of a respective chamber filled with pressure fluid, a further side of each cahmber being formed by one of a respective membrane of the differential pressure cell and a membrane of a respective one of the two absolute pressure cells, which are in alignment with one another.

* * * * *